United States Patent [19]

Vulovic

[11] 4,043,288

[45] Aug. 23, 1977

[54] SHIP LOADING RAMP

[75] Inventor: Radoje Vulovic, Swarthmore, Pa.

[73] Assignee: Sun Shipbuilding and Dry Dock Co., Chester, Pa.

[21] Appl. No.: 625,222

[22] Filed: Oct. 23, 1975

[51] Int. Cl.[2] ..... B63B 27/14

[52] U.S. Cl. ..... 114/270; 14/71.1

[58] Field of Search ..... 114/.5 R, 231, 270; 14/71, 72, 71.3, 71.1

[56] References Cited

U.S. PATENT DOCUMENTS

| | | | |
|---|---|---|---|
| 2,778,958 | 2/1957 | Hodges et al. | 14/72 |
| 3,735,440 | 5/1973 | Hetmanski | 14/71 |
| 3,808,625 | 8/1972 | Fowler | 14/71 |
| 3,971,090 | 7/1976 | Vulovic | 114/270 X |

FOREIGN PATENT DOCUMENTS

| | | | |
|---|---|---|---|
| 2,046,900 | 5/1971 | Germany | 114/270 |
| 113,472 | 5/1969 | Norway | 114/270 |

*Primary Examiner*—Trygve M. Blix
*Assistant Examiner*—Gregory W. O'Connor
*Attorney, Agent, or Firm*—J. Edward Hess; Donald R. Johnson

[57] ABSTRACT

A ship loading ramp designed to allow for substantial changes in tide. The ramp pivots about a pair of lugs at each end. Each lug extends from one corner of the ramp into a fitting having an upward opening slot. One set of slotted fittings is in a tailpiece on the pier, and the second set of slotted fittings is located on the deck of the ship. As the level of the ship deck falls below the level of the pier the ramp will settle on the pier and lift out of the slotted fittings on the ship deck, thereby freeing the ramp from the ship. As the ship later rises with the tide, the slotted fittings on the ship will engage the lugs on the ramp and will proceed to raise and tilt the ramp. During this period of rising tide, the ramp will become further and further inclined until it reaches a maximum positive angle of inclination. At this maximum angle, a pair of cables extending from the ship to the ramp will pull taut and proceed to lift the ramp out of the slotted fittings on the tailpiece and into the air. As the ship later falls with the tide, the lugs on the ramp will engage the slotted fittings in the tailpiece, and the ramp will be usable again.

13 Claims, 1 Drawing Figure

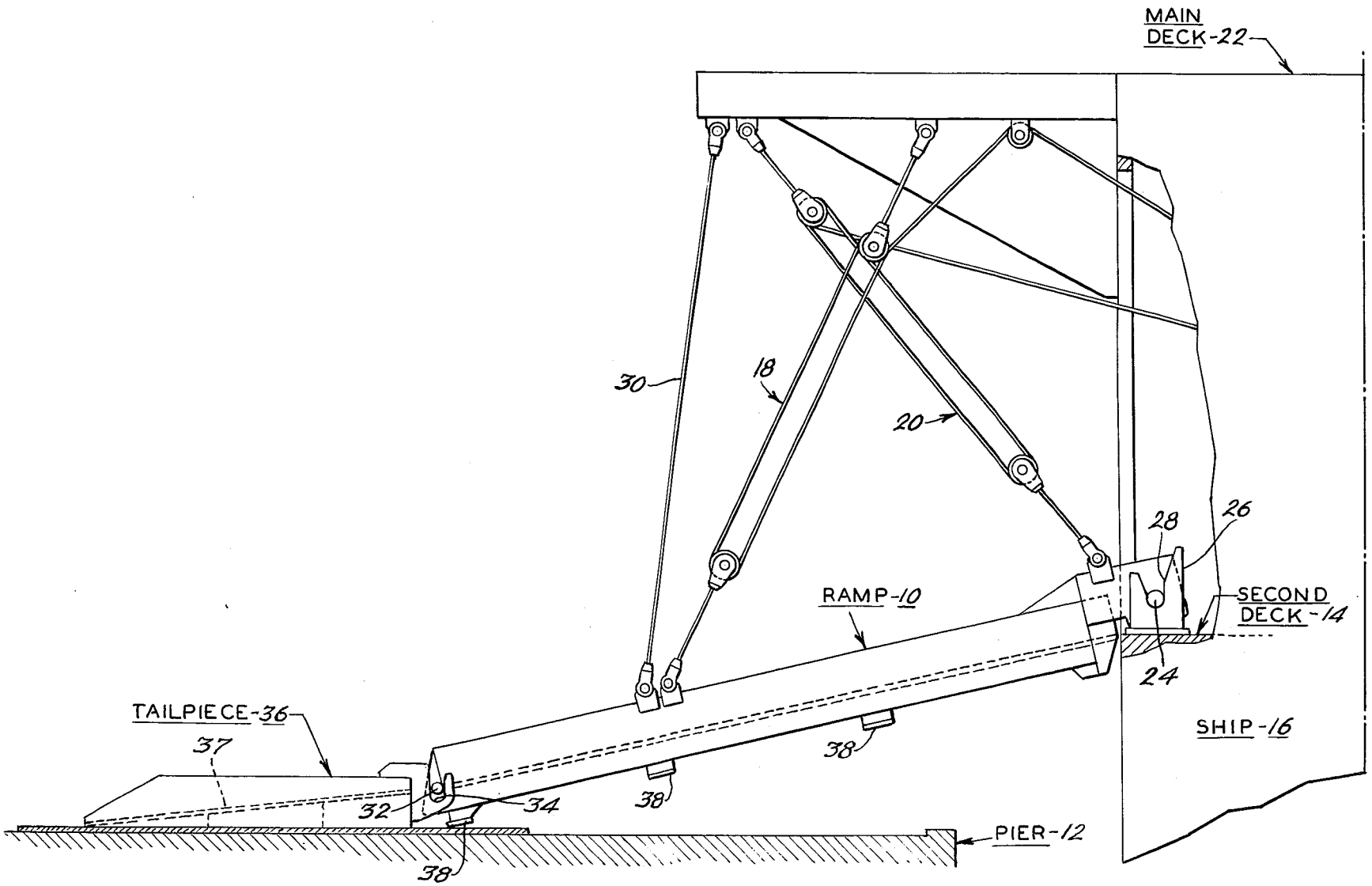
MAIN DECK-22
SECOND DECK-14
SHIP-16
26
28
24
PIER-12
20
RAMP-10
38
18
30
38
34
38
32
TAILPIECE-36
37

SHIP LOADING RAMP

BACKGROUND OF THE INVENTION

The present invention relates generally to a loading ramp for a ship, and more particularly relates to a loading ramp which must have a limited length because of physical restrictions on the pier, and which is designed to allow for substantial tidal changes.

When designing a loading ramp for a ship, the effect of changes in tide and draft must be taken into consideration. Loading ramps may be designed to carry cargo on and off a vessel between a maximum positive angle (ship above pier) and a maximum negative angle (ship below pier). Often, a rather large tidal swing may be accomodated within a maximum positive and negative angles by utilizing a rather long ramp. The ramp of the present invention was designed for a situation wherein tidal changes are rather large, and also wherein the maximum length of the ramp is restricted because of physical arrangements on the pier.

SUMMARY OF THE INVENTION

In accordance with a preferred embodiment, a loading ramp system is disclosed which allows a relatively short floating ramp to be utilized in a port having relatively large tidal changes. To accomodate the large tidal changes the ramp is designed to be utilized during only a portion of the tidal cycle.

In accordance with a preferred embodiment, a loading ramp system is disclosed which allows the ramp to be uncoupled from either the ship or the pier as the tide causes the ship to rise or fall relative to the pier. The ship end of the ramp is detachably coupled to the pier such that the ramp is vertically lifted out of the ship's coupling when the tide lowers the level of the ship's deck below the level of the pier. Further, as the tide later raises the level of the ship's deck, the coupling system allows the ramp to settle back into its couplings. As the ship continues to rise, the ramp is tilted until it is supported by the ship at a maximum positive angle, and then the ramp is lifted from its detachable supports on the pier. As the tide later recedes, the ramp will settle back into its detachable supports on the pier.

BRIEF DESCRIPTION OF THE DRAWINGS

The drawing shows a side view of one embodiment of a ship loading ramp system designed to allow for substantial tidal changes.

DETAILED DESCRIPTION OF AN EMBODIMENT

Referring to the drawing, there is illustrated a side view of a loading ramp 10 which is coupled between a pier 12 and the second deck 14 of a ship 16. The ship is typically fitted with a pair of opposing block and pulley systems 18 and 20 which are supported from overhead structure adjacent to a main deck 22. The block and pulley system 18, which is typically powered by a motorized winch, may be utilized to pull the ramp closer to the ship, while the block and pulley system 20, which is also typically powered by a motorized winch, may be utilized to pull the ramp away from the ship. The ramp 10 is coupled to the ship by a pair of lugs 24, one of which extends from each side of the ship end of the ramp. Each lug is supported in a fitting 26 having an upward opening slot 28. As illustrated, the slot may have a wide mouth to facilitate the initial positioning of the ramp within the fittings. The ramp is also coupled to the ship by a pair of cables 30, one of which is positioned on each side of the ramp. The length of the cables is such that they will become taut when the rising tide causes the ramp to reach a maximum allowable positive angle with respect to the pier. The pier end of the ramp is similarly supported by a pair of lugs 32, one of which extends from each side of the pier end of the ramp. The lugs are supported within a pair of upward opening slotted fittings 34 at one end of a tailpiece 36. As illustrated, each slotted opening may have a wide entrance to facilitate the initial positioning of the lugs 32 into the fittings. The ramp 10 includes footings 38 on its bottom to support the ramp when it is sitting on the pier. The tailpiece 36 has a rampway 37 at a slight positive angle to break the angular difference between the surface of the pier and the surface of the ramp into two separate and smaller angles.

The ramp system is designed to operate as follows. As the tide causes the level of the ship to fall below the level of the pier, the ramp will settle down horizontally onto the pier, and lift out of the slotted fittings on the ship, thereby freeing the ramp from the ship except for the cables extending between the two. As the tide causes the ship to rise later, the slotted fittings on the ship will engage the lugs on the ramp and the rising ship will proceed to raise and tilt the ramp. During this period of rising tide, the ramp will become further and further inclined until it reaches a maximum positive angle with respect to the pier. In one embodiment, this maximum positive angle was chosen to be 12°. At this angle the cables 30 will pull taut and proceed to lift the ramp out of the slotted fittings on the tailpiece and into the air. As the tide later recedes, the lugs on the pier end of the ramp will engage the slotted fittings in the tailpiece, and the ramp will again be usable to load and unload cargo.

Although at least one embodiment of the present invention has been described, the teachings of this invention will suggest many other embodiments to those skilled in the art.

The invention claimed is:

1. A ship loading ramp system designed to allow for a substantial change in tide by providing for automatic coupling and uncoupling to the ramp and comprising:

a. a ramp adapted to extend from a pier to the deck on a ship;

b. means for detachably coupling the ship end of said ramp to the ship such that the ramp may be vertically lifted out of the coupling means when the tide lowers the level of the ship's deck below the level of the pier, and the ramp may settle back into the coupling means when the tide raises the level of the ship's deck above the level of the pier;

c. means for supporting the ramp at a maximum positive angle as the tide raises the level of the ship above the level of the pier; and d. means for detachably supporting the pier end of said ramp on the pier such that as the tide causes the level of the ship to rise, ship end of said ramp will be raised until the ramp reaches said maximum positive angle as defined by said ramp supporting means and the ramp will then proceed to be lifted off the pier at said maximum positive angle until the tide recedes and the ramp end of the ramp is again supported by the pier.

2. A system as set forth in claim 1 wherein said coupling means includes a lug extending from each side of the ship end of the ramp and slotted coupling means on the ship adapted to hold said lugs.

3. A system as set forth in claim 2 wherein said slotted coupling means includes first and second slotted fittings spaced apart on the deck of the ship by approximately the width of the ramp.

4. A system as set forth in claim 3 and further wherein said detachable supporting means includes a tailpiece on the pier and adapted to couple to the pier end of the ramp.

5. A system as set forth in claim 4 and wherein said detachable supporting means further includes a lug extending from each side of the pier end of said ramp, and said tailpiece includes a pair of slotted fittings for receiving the lugs extending from the sides of the pier end of the ramp.

6. A system as set forth in claim 5 and wherein said supporting means for the ramp includes a cable means extending from the ship to said ramp.

7. A system as set forth in claim 5 wherein said cable means attaches to the ramp closer to the pier end of the ramp than to the ship end of the ramp.

8. A system as set forth in claim 7 wherein said ramp includes a plurality of footings attached to the bottom of the ramp for supporting the ramp horizontally on the pier when the tide causes the level of the ship's deck to drop below the level of the pier.

9. A system as set forth in claim 1 and further wherein said detachable supporting means includes a tailpiece on the pier and adapted to couple to the pier end of the ramp.

10. A system as set forth in claim 9 and wherein said detachable supporting means further includes a lug extending from each side of the pier end of said ramp, and said tailpiece includes a pair of slotted fittings for receiving the lugs extending from the sides of the pier end of the ramp.

11. A system as set forth in claim 1 wherein said supporting means for the ramp includes a cable means extending from the ship to said ramp.

12. A system as set forth in claim 11 wherein said cable means attaches to the ramp closer to the pier end of the ramp than to the ship end of the ramp.

13. A system as set forth in claim 1 wherein said ramp includes a plurality of footings attached to the bottom of the ramp for supporting the ramp horizontally on the pier when the tide causes the level of the ship's deck to drop below the level of the pier.

* * * * *